US006655982B2

(12) United States Patent
Bolliger et al.

(10) Patent No.: US 6,655,982 B2
(45) Date of Patent: Dec. 2, 2003

(54) ELECTRICAL TERMINAL

(75) Inventors: Roman Marcel Bolliger, Allschwil (CH); Lars Thomas Bolliger, Allschwil (CH)

(73) Assignee: Woertz AG, Muttenz (CH)

( * ) Notice: Subject to any disclaimer, the term of this patent is extended or adjusted under 35 U.S.C. 154(b) by 0 days.

(21) Appl. No.: 10/222,859

(22) Filed: Aug. 19, 2002

(65) Prior Publication Data

US 2003/0040208 A1 Feb. 27, 2003

(30) Foreign Application Priority Data

Aug. 20, 2001 (CH) ..... 1535/01

(51) Int. Cl.[7] ..... H01R 11/20

(52) U.S. Cl. ..... 439/409; 439/395; 439/716; 439/532

(58) Field of Search ..... 439/409, 417, 439/395, 403, 404, 532, 716

(56) References Cited

U.S. PATENT DOCUMENTS

| | | | | | |
|---|---|---|---|---|---|
| 4,466,682 | A | * | 8/1984 | Jusseau et al. | 439/391 |
| 4,729,738 | A | * | 3/1988 | Heng et al. | 439/395 |
| 6,120,315 | A | * | 9/2000 | Gaertner et al. | 439/395 |
| 6,478,605 | B2 | * | 11/2002 | Stuckmann et al. | 439/409 |
| 6,500,021 | B2 | * | 12/2002 | Wilmes et al. | 439/409 |

* cited by examiner

*Primary Examiner*—Tho D. Ta
(74) *Attorney, Agent, or Firm*—Breiner & Breiner, L.L.C.

(57) ABSTRACT

An electrical terminal including a housing (1) for receiving a contact element (2) having fork-shaped receptacles and pivotable drive elements (3–6). Contact element (2) has with four receptacles (9–12) each designed to connect a conductor. The receptacles as well as the associated drive elements (3–6) are configured pairwise in two planes one above the other in order to allow as many as four connections while being of minimum bulk.

7 Claims, 1 Drawing Sheet

ELECTRICAL TERMINAL

FIELD OF INVENTION

The present invention relates to an electrical terminal including an insulating housing which receives a stationary electrically conducting contact element with fork-shaped receptacles constituting cutting blades and several tool-pivoted drive elements each designed to keep in place an electrical conductor clad in an insulated sheath and to cut through the insulated sheath when such a conductor is pivoted out of an initial position in one of the fork-shaped receptacles of the contact element and to drive the area of the conductor freed of its insulation into conducting clamped contact with the contact element while the drive element locks into its end position.

BACKGROUND OF THE INVENTION

Insulation-stripping screwless terminals are known and particular designs are disclosed, for example, in Swiss Patents Nos. 653 813; 664 647 and 667 164. These known terminals exhibit a housing fitted with a foot for affixation to a support rail. Such terminals are used to hook up incoming and outgoing lines, the two conductors being electrically connected to each other in simple and rapid manner by the contact element configured in the housing.

It has been found, however, that contemporary terminals having one hook-up for an incoming line and one hook-up for an outgoing line frequently are inadequate. An expanded design having more than two hook-up sites in the form of consecutive receptacles and associated pivotable drive elements not only entails complex manufacture, but also entails a commensurate larger bulk to the terminal on account of the required extension of the contact element.

OBJECTS OF THE INVENTION

A primary object of the present invention is to provide a terminal design including four connection sites and yet remaining compact in size.

Particular embodiment modes of the terminal of the invention are defined in the claims.

The object of the invention is elucidated by means of an illustrative embodiment shown in the drawings.

DESCRIPTION OF THE PRESENTLY PREFERRED EMBODIMENTS

Figure 1:
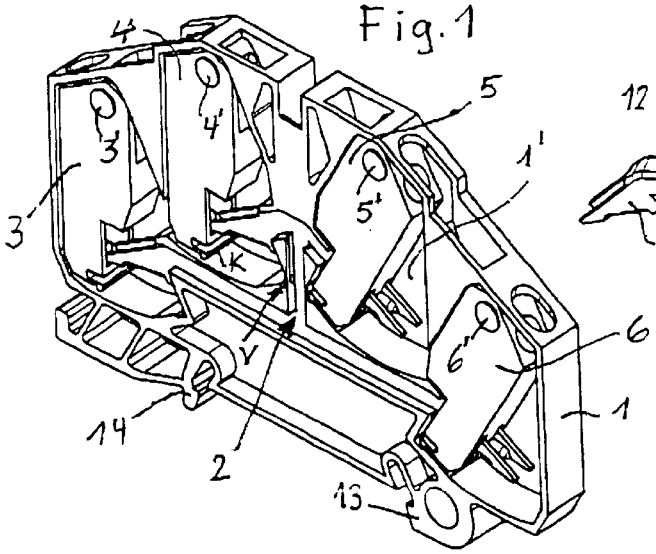
FIG. 1 is a perspective of a terminal of the present invention.
Figure 2:
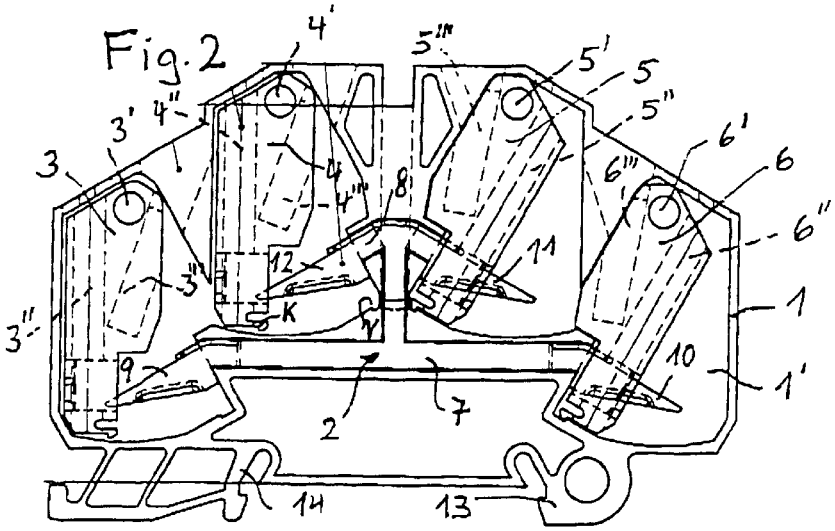
FIG. 2 is a front view of the terminal of FIG. 1.
Figure 3:
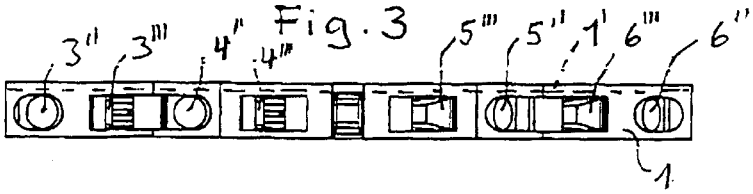
FIG. 3 is a top view of the terminal of FIG. 2.

The electrical non-stripping electrical terminal shown in FIGS. 1–3 includes an electrically insulating housing 1 which is open on one side and fitted on the other side with a closed rear wall 1'. The unilaterally open compartments (each closed by a series-configured terminal or its back wall) receive on one hand an electrically conducting contact element 2 which is installed in a fixed manner and on the other hand pivotable drive elements 3, 4, 5 and 6. The drive elements 3–6 are pivotable around bolts 3'–6' by about 30°–40° as elucidated below.

Figure 4:
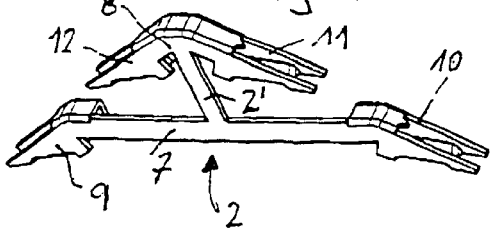
FIG. 4 is a perspective of a contact element insertable into the terminal.

The contact element 2 is shown in detail in FIG. 4 and assumes the shape of a prone H exhibiting at each end an upper leg 8 which is shorter than the lower leg 7. The four leg ends are fitted with fork-shaped receptacles 9 through 12 which are fitted with cutting blades on the inside in order sever or peel off the insulation of a conductor forced between them and hence set up electrical contact between the (not shown) conductor and the contact element.

Since the four forked receptacles open toward the housing's side walls and are configured pairwise (9, 10; 11, 12) in two planes mutually spaced apart and since the pivotable drive elements 3–6 also are pairwise connected in two planes, it is now possible to implement four connections in one compact geometry.

The drive elements 3–6 each are fitted with a continuous receiving borehole 3"–6" and one aperture 3"–6'" for admitting a driving tool (for example a screwdriver) and with a pawl K which in the operational position of the drive elements enters a particular recess of the housing 1.

A conductor (not shown) to be hooked up is inserted into a particular receiving borehole 3"–6" until abutting a housing surface and then is pivotable by the tool of the drive elements 3–6. The conductor in this process is pressed between the cutting blades of the receptacles 9–12 and the insulation is peeled off on both sides of the conductor to attain reliable electrical contact between it and the contact element 2. Depending on the conductor's cross-section and its type (solid/stranded wire), the resilient fork-shaped receptacle 9–12 shall be bent apart more or less.

In the embodiment shown, the two left drive elements 3, 4 assume their initial positions (before conductor insertion) and the two right drive elements 5, 6 are in their operational positions (locked conductor positions).

The terminal of the invention allows connecting up to four conductors which, when using the integral contact element 2, all are interconnected. If the terminal was to be used to connect only two connectors, the connecting strip 2' may be interrupted. In that case, the terminal has two pairs of connections 9,10 and 11, 12.

If the terminal is to be used to connect only three conductors, one of the four drive elements need not be installed (then preferably closing the appropriate connection aperture in the housing, for example by means of a plastic lid). The housing 1 is fitted with feet 13, 14 which allow clamping of the terminal onto a supporting rail.

As will be apparent to one skilled in the art, various modifications can be made within the scope of the aforesaid description. Such modifications being within the ability of one skilled in the art form a part of the present invention and are embraced by the appended claims.

It is claimed:

1. An electrical terminal comprising an electrically insulating housing, an electrically conducting contact element present in said housing and having a plurality of fork-shaped receptacles including cutting surfaces, a plurality of pivotable drive elements present in said housing, said drive elements keeping an electrical conductor clad with an insulating sheath against the contact element to which the conductor is connected, the insulating sheath of said conductor when pivoted out of a first position in one of the fork-shaped receptacles of the contact element is cut by one of said drive elements and a segment of the conductor so bared of insulation moving into conducting clamped contact with the contact element, wherein the contact element comprises four fork-shaped receptacles adapted to connect one conductor, said receptacles being configured pairwise-open toward the side walls of the housing on opposite sides, a first pair of said receptacles being situated in a lower housing plane and a second pair of said receptacles being situated on a relatively higher housing plane, the first pair of said receptacles being longer in length than the second pair, and the pivotable drive elements which cooperate with the receptacles are correspondingly linked in the housing in a pairwise manner and in different planes.

2. The electrical terminal as claimed in claim 1, wherein said drive elements are installed in at least two electrically connected receptacles.

3. The electrical terminal as claimed in claim 1, wherein the contact element is substantially configured as a prone H comprising a shortened upper leg at both ends and open fork-shaped receptacles at both leg ends.

4. The electrical terminal as claimed in claim 1, wherein the contact element is integral and thereby all said receptacles for conductors to be connected are electrically interconnected.

5. The electrical terminal as claimed in claim 4, wherein said drive elements are installed in at least two electrically connected receptacles.

6. The electrical terminal as claimed in claim 1, wherein the contact element further comprises two electrically separate parts each of which including one of the first pair or the second pair of receptacles.

7. The electrical terminal as claimed in claim 6, wherein said drive elements are installed in at least two electrically connected receptacles.

* * * * *